US009375593B2

(12) United States Patent
Fishman et al.

(10) Patent No.: US 9,375,593 B2
(45) Date of Patent: Jun. 28, 2016

(54) AEROSOL FIRE EXTINGUISHER WITH TRIGGER SPRAYER

(76) Inventors: Michael Fishman, Coral Springs, FL (US); Neal Markus, Hollywood, FL (US)

( * ) Notice: Subject to any disclaimer, the term of this patent is extended or adjusted under 35 U.S.C. 154(b) by 861 days.

(21) Appl. No.: 13/165,316

(22) Filed: Jun. 21, 2011

(65) Prior Publication Data

US 2012/0325503 A1 Dec. 27, 2012

(51) Int. Cl.

| | |
|---|---|
| ***B05B 7/32*** | (2006.01) |
| ***A62C 13/64*** | (2006.01) |
| ***A62C 13/00*** | (2006.01) |
| ***A62C 99/00*** | (2010.01) |

(52) U.S. Cl.

CPC ..... *A62C 13/64* (2013.01); *A62C 13/003* (2013.01); *A62C 99/0018* (2013.01)

(58) Field of Classification Search

CPC .... A62C 11/00; A62C 13/003; A62C 13/006; A62C 13/62

USPC ..... 169/75, 30, 71, 77, 85, 88

See application file for complete search history.

(56) References Cited

U.S. PATENT DOCUMENTS 3,974,945 A * 8/1976 Burger ..... 222/192
5,588,987 A * 12/1996 Huston ..... 95/260
6,305,619 B1 * 10/2001 Thurn ..... A01M 21/043 222/175
2006/0273111 A1 * 12/2006 Heatley et al. ..... 222/153.06
2008/0128145 A1 * 6/2008 Butz et al. ..... 169/46
2009/0277653 A1 * 11/2009 Mori ..... 169/30
2010/0243672 A1 * 9/2010 Gosis ..... B65D 83/206 222/1
2010/0269762 A1 * 10/2010 Johnson ..... 119/712

* cited by examiner

*Primary Examiner* — Davis Hwu

(57) ABSTRACT

An Aerosol Fire Extinguisher with Trigger Sprayer that can be easily held in one hand. The extinguishing agent is under pressure in an aerosol can and can only be released by pulling the tab of the trigger sprayer. The Trigger Sprayer Unit cannot be sprayed until the tab is pulled. The Can is a cylindrical canister housing and has a Dip Tube that goes to the bottom of the can to the Fire Extinguishing Agent. There is Propellant in the can that pushes the Fire Extinguishing Agent up through the Dip Tube. Pulling the tab of the Sprayer Unit allows the Trigger to be pressed and be moved so the Trigger Pivoting Member of the Trigger Sprayer Unit is able to press down on the stem of the Mounting Cup of the Can which then allows the Propellant in the Can to force the Fire Extinguishing Agent through the Dip Tube up through the Chamber Hole into the Direction Chamber with pressure out the Nozzle toward the fire. The user then holds down the trigger and sprays the fire with the Fire Extinguishing Agent until the fire is out.

19 Claims, 6 Drawing Sheets

AEROSOL FIRE EXTINGUISHER WITH TRIGGER SPRAYER

CROSS-REFERENCE TO RELATED APPLICATIONS

None

FEDERALLY SPONSORED RESEARCH

None

SEQUENCE LISTING

None

BACKGROUND

Traditional way of fighting fires is the use of a large Fire Extinguisher that can be bulky and has a complicated pull pin mechanism to dispense the fire extinguishing agent. This invention addresses a new way fighting fires using an aerosol can and trigger sprayer that is both easy to use and fast. The Trigger Sprayer allows the user to be able to pull the tab and spray a fire extinguishing agent onto the fire to put the fire out. When the tab is not pulled the Aerosol Fire Extinguisher with Trigger sprayer cannot be sprayed. Additionally this invention can easily be held in one hand for ease of use and portability.

SUMMARY OF THE INVENTION

The invention is an aerosol fire extinguisher with a trigger sprayer. In a preferred embodiment of the invention the trigger sprayer is fitted onto a mounting cup with a dip tube going to the bottom of the aerosol can to the Fire Extinguishing Agent. The Direction Chamber allows the Fire Extinguishing Agent to flow through the trigger sprayer to the nozzle where it will flow out toward the fire. The Trigger pivots up and down that puts pressure on the Direction Chamber that puts pressure on the actuator stem allowing the fire extinguishing Agent to flow up. The nozzle on the trigger sprayer can is configured to allow the fire extinguishing agent to flow out rapidly. There is a propellant inside the can with the Fire Extinguishing Agent. A Mounting Cup is placed in the Hole ate the top of the Aerosol Can and holds the pressure of the Propellant and Fire Extinguishing Agent. The Mounting Cup of the aerosol can has a actuator stem that when it is depressed cause the fire Extinguishing Agent to flow out. The propellant can be CO2, Air, Nitrogen or 134a. The aerosol can is cylindrical. The Trigger sprayer of the aerosol fire extinguisher has a tab on top of it that can be easily be pulled off which allows the trigger to be depressed and ready to be used. When this tab is not pulled no Fire Extinguishing agent can come out of the aerosol fire extinguisher for easy storage. The Tab has breakaway hinges and can be snapped off easily. The Trigger can be depressed by an index finger or other fingers to release the Fire Extinguishing Agent. The Trigger Sprayer has a nozzle wherein the Fire Extinguishing Agent can flow out.

OPERATION OF THE INVENTION

When the Tab is not pulled the Trigger of the Aerosol Fire Extinguisher is locked and cannot be sprayed. The operation of the Aerosol Fire Extinguisher with trigger sprayer is when there is a fire and it is needed for use, the user simply pulls the tab of the Aerosol Fire Extinguisher Trigger Sprayer which is located on top and this enables the trigger assembly to be pushed down on the mounting cup that has a stem sticking up that when depressed allows the propellant in the can to push the Fire Extinguishing Agent up through the stem through the Trigger Sprayer Unit through the Direction Chamber then through the Nozzle toward the fire. The Fires Extinguishing Agent comes out with pressure and because the trigger has a nozzle the user can easily identify the direction to spray the Fire Extinguishing Agent.

DETAILED DESCRIPTION

Figure 1:
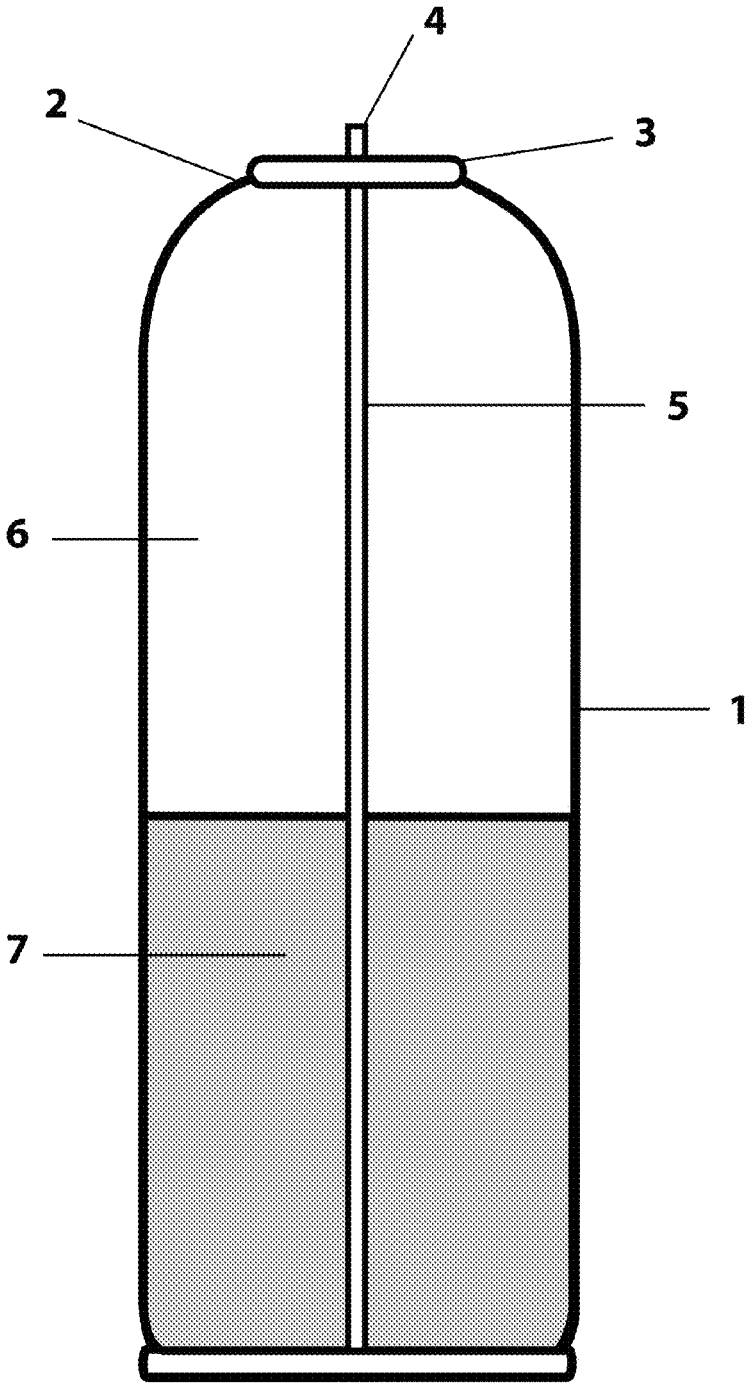
FIG. 1 shows a perspective view of only the Can with the Mounting Cup and stem alone in a preferred embodiment of the invention.

Referring now to FIG. 1, a preferred embodiment of the invention is a Can 1 that is strong enough to withhold aerosol can pressure. The Can 1 has a Can Hole 2 at the top of the can. A Mounting Cup 3 at the top of the can is configured to fit on top of Can 1 into the Can Hole 2. The Mounting Cup 3 has a Actuator Stem 4 which is attached to it and a Dip Tube 5 extends from the stem through the mounting cup into the Can 1. The Can 1 is filled partially with a Fire Extinguishing Agent 7 inside the Can 1. The Can 1 is also filled partially with a Propellant 6.

Figure 2:
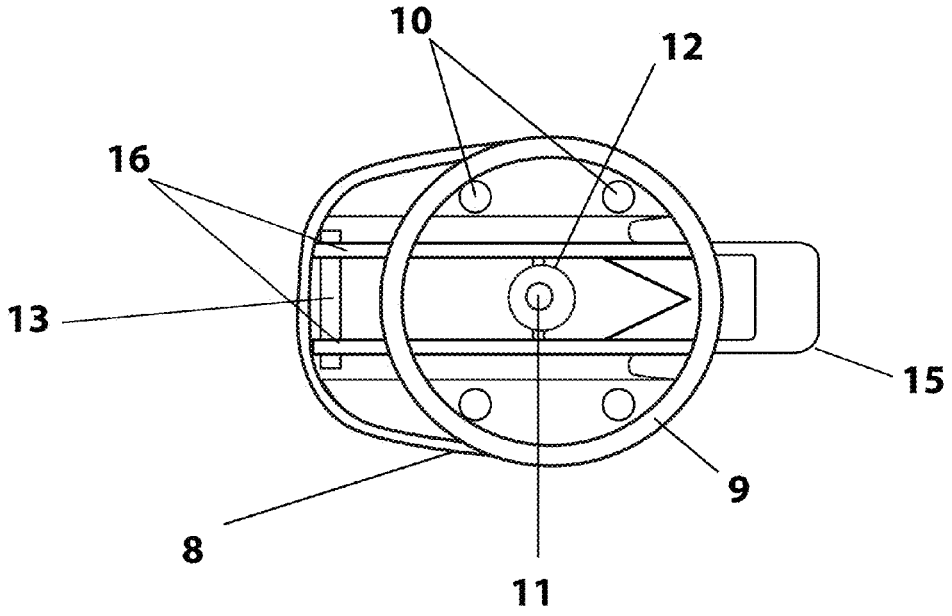
FIG. 2 shows a perspective view of the Trigger Sprayer Unit from the bottom of the Trigger Sprayer Unit in a preferred embodiment of the invention.

Referring now to FIG. 2-a preferred embodiment of the invention shows the bottom of a Trigger Spraying Unit 8 in a preferred embodiment of the invention. The Trigger Sprayer Unit 8 has a Rim 9 configured to snap onto the Mounting Cup 3. The Trigger Sprayer Unit also has one or more Fitting Units 10 that are configured to support and to grasp onto the Mounting Cup 3. The Trigger Sprayer Unit 8 has a Chamber Hole 11 which secures over the Actuator Stem 4. The Chamber Hole 11 leads into a Direction Chamber 12 and is attached to the back of the Trigger Sprayer Unit 8. A Trigger 15 is able to pivot up and down. The Trigger 15 uses a Trigger Pivoting Member 16 to pivot up and down and is held in place by a Trigger Pivoting Member Holder 13.

Figure 3:
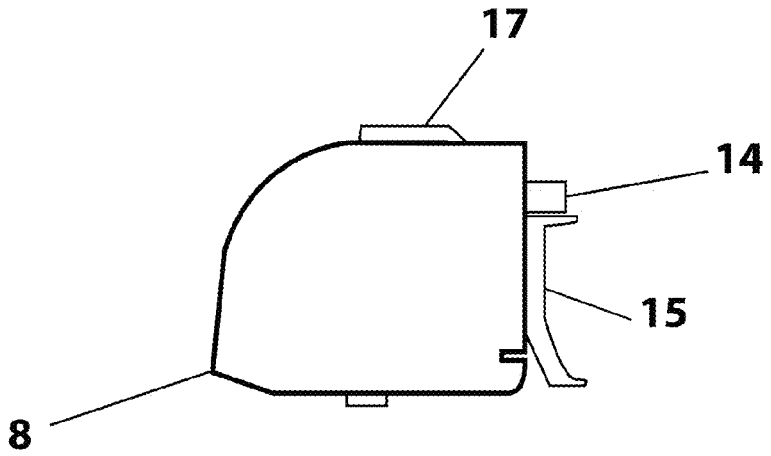
FIG. 3 shows a perspective side view of the trigger sprayer with the tab intact, FIG. 4 Shows a cross sectional view of the Trigger Sprayer with tab intact.

Referring now to FIG. 3 a preferred embodiment of the invention shows a perspective side view of the Trigger Sprayer Unit 8. A Tab 17 is fitted on top of the Trigger Sprayer Unit 8 which is attached to the Trigger 15 in a preferred embodiment of the invention. The Tab 17 must be removed for the Trigger 15 to move and therein being able to move the Nozzle14.

Figure 4:
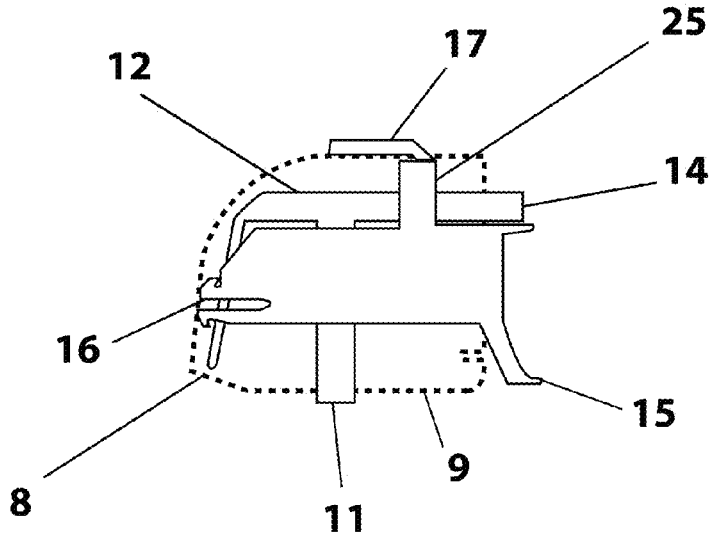

Referring now to FIG. 4 a cross sectional view of the Trigger Sprayer Unit 8. The Chamber Hole 11 is at the bottom and the Rim 9 can be seen that fits over the Mounting Cup 3. A Trigger 15 fits inside the Trigger Sprayer Unit 8. The Chamber Hole 11 goes into a Direction Chamber 12 which is hollow and allows the Fire Extinguishing Agent 7 to flow through. The Fire Extinguishing Agent 7 flows through the Chamber Hole 11 into Direction Chamber 12 out a Nozzle 14. The Trigger 15 Pivots up and down by being pressed and by way of its trigger Pivoting Member 16. The Trigger 15 has a Nozzle Holder 25 that holds onto the Nozzle 14.

Figure 5:
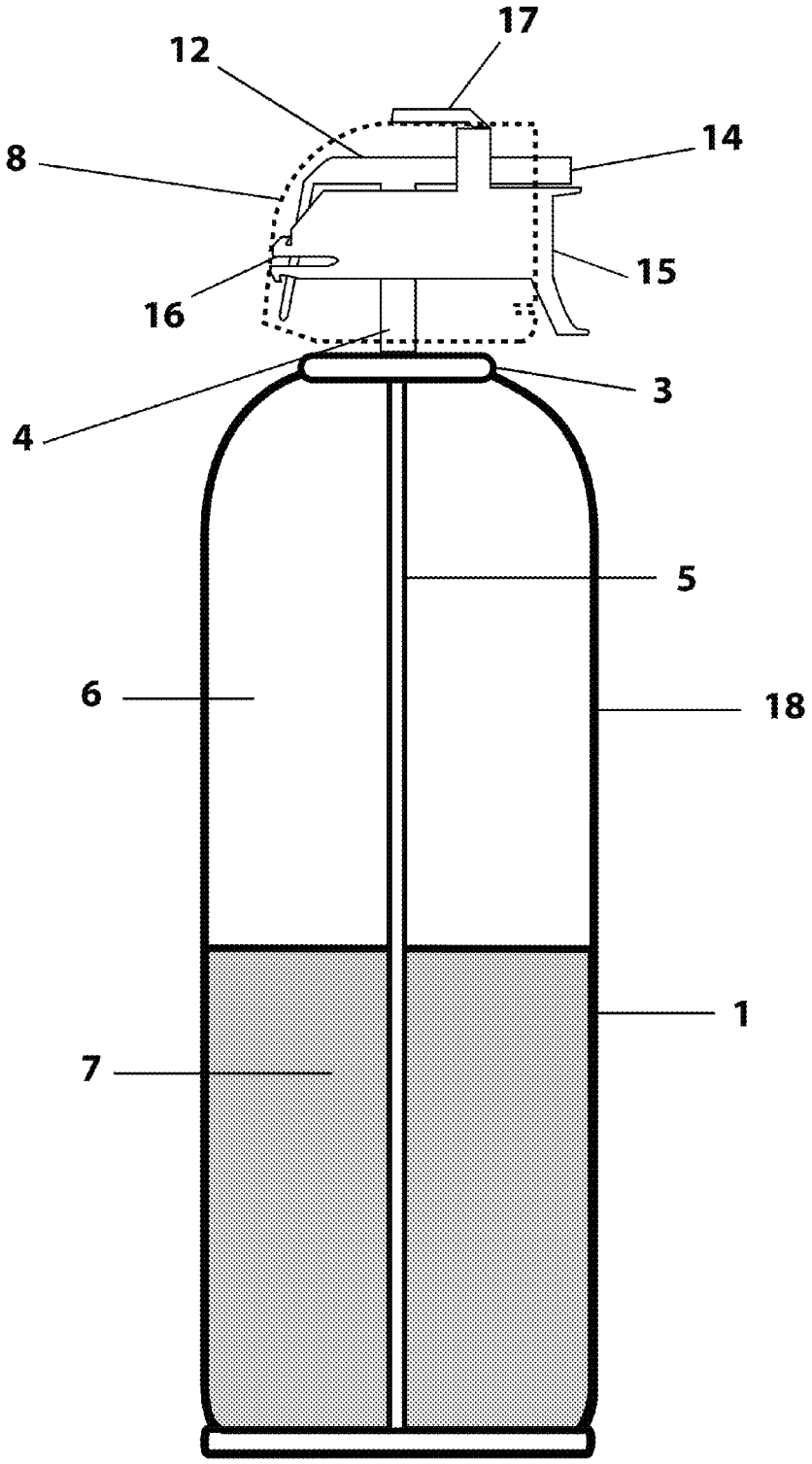
FIG. 5 shows Perspective Cross Sectional view of the aerosol fire extinguisher with a trigger sprayer and tab intact in a preferred embodiment of the invention.
Figure 6:
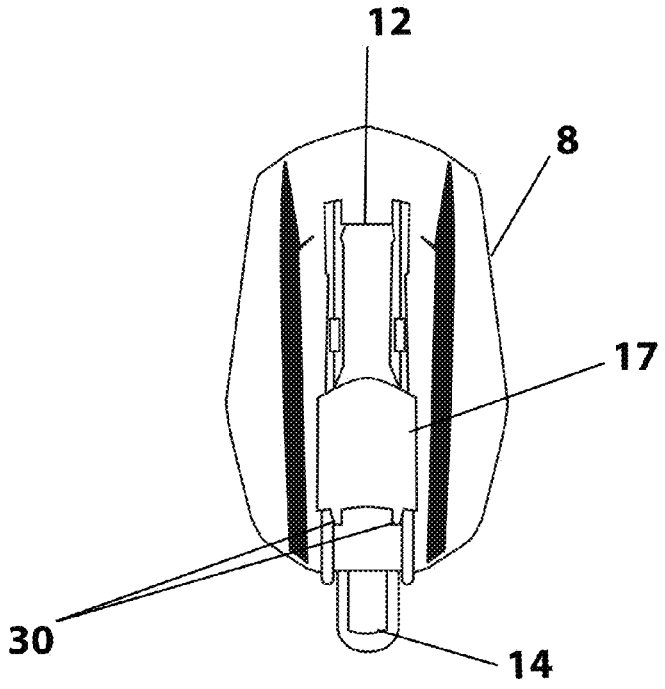
FIG. 6 shows a Perspective view of the trigger sprayer looking from above.

Referring now to FIG. 5 which shows a perspective side view of a Aerosol Fire Extinguisher with Trigger. A Aerosol Fire Extinguisher with Trigger Whole Unit 18 is shown as the whole invention. In this perspective view the Can 1 is shown filled with the Fire Extinguishing Agent. The upper portion of the can is filled with the Propellant 6 and the Dip Tube 5 goes down to the Fire Extinguishing Agent 7. A Mounting Cup 3 holds the pressure inside the Can 1. The Trigger Sprayer Unit 8 fits onto the Actuator Stem 4 onto the Mounting Cup 3. The Direction Chamber as it fits on the Actuator Stem 4 is shown. The Tab 17 as it fits on top of the Trigger Sprayer Unit 8 and the Nozzle 14 wherein the Fire Extinguishing Agent 7 flows out. The Trigger Pivoting 16 can be seen in Referring now to FIG. 6 shows a view of the trigger sprayer looking from above. The Tab 17 is shown as it sits on top of the Trigger Sprayer Unit 8. In this perspective view the tab has Breakaway Hinges 30 that allows the Tab 17 to be pulled off. When the Tab 17 is pulled off the Nozzle 14 and Direction Chamber 12 are free to move up and down as the Trigger 15 is pressed.

The invention claimed is:

1. An aerosol fire extinguisher with trigger sprayer comprising:

1. (a) a aerosol can:
   1. contains a fire extinguishing agent;
   2. contains propellant;
(b) a trigger sprayer that is comprised of:
   1. a trigger that is depressed horizontally by a finger or fingers;
   2. a nozzle in which the fire extinguishing agent will be dispensed under pressure and flow through when the trigger is depressed;
(c) a mounting cup affixed to the can:
(d) a dip tube that extends from the mounting cup to the extinguishing agent;
2. The trigger is operable by pulling the trigger towards the container in a horizontal direction using one's index finger or middle finger for opening the actuator stem and for closing the actuator stem by releasing the trigger:
3. The trigger pivots the nozzle about a hinge causing the actuator stem to release pressure causing the fire extinguishing agent to flow up into a direction chamber and out the nozzle:
4. the fire extinguishing agent contains a percentage of AFFF:
5. The propellant is either CO2 or nitrogen.

2. An aerosol fire extinguisher with trigger sprayer comprising:

1. (a) A aerosol can:
   1. that contains a fire extinguishing agent;
   2. contains propellant;
(b) A trigger sprayer that contains:
   1. a tab that can be pulled allowing the trigger to be depressed;
   2. a trigger that is depressed horizontally by a finger or fingers;
(c) a mounting cup affixed to the can;
(d) a dip tube that extends from the mounting cup to the extinguishing agent;
2. The trigger is operable by pulling the trigger towards the container in a horizontal direction using one's index finger or middle finger for opening the actuator stem and for closing the actuator stem by releasing the trigger:
3. a nozzle wherein the fire extinguishing agent flows out operative for discharging the fire extinguishing agent from the container through the actuator stem, the trigger having a tab for opening and closing the actuator stem to selectively discharge the fire extinguishing agent from the nozzle:
4. the trigger pivots the nozzle about a hinge causing the actuator stem to release pressure causing the fire extinguishing agent to flow up into a direction chamber and out the nozzle:
5. the fire extinguishing agent contains a percentage of AFFF:
6. the propellant is either CO2 or nitrogen.

3. An aerosol fire extinguisher with trigger sprayer comprising:

1. (a) A aerosol can:
   1. contains a fire extinguishing agent;
   2. contains a propellant;
(b) A mounting cup that goes on the aerosol can;
(c) A dip tube that extends to the bottom of the aerosol can to the extinguishing agent from the mounting cup;
(d) A rigger sprayer that contains;
   1. a tab that can be pulled allowing the trigger to be depressed and if the tab is not pulled from the trigger no fire extinguishing agent will flow out;
   2. a trigger that can be depressed by a finger or fingers;
2. a direction chamber wherein the fire extinguishing agent fill will flow through:
3. a nozzle wherein the fire extinguishing agent flows out;
   b. A Trigger Sprayer that is comprised of;
      1. a trigger that is depressed horizontally by a finger or fingers;
      2. a nozzle in which the fire extinguishing agent will be dispensed under pressure and flow through when the trigger is depressed;
      3. the trigger is operable by pulling the trigger towards the container using ones's index finger or middle finger in a horizontal direction for opening the actuator stem and for closing the actuator stem by releasing the trigger;
      4. the Nozzle wherein the fire extinguishing agent flows out the operative for discharging the fire extinguishing agent from the container through the actuator stem, the trigger having a tab for opening and closing the actuator stem to selectively discharge the fire extinguishing agent from the nozzle;
      5. the trigger pivots the nozzle about a hinge causing the actuator stem to release pressure causing the fire extinguishing agent to flow up into the direction chamber and out the nozzle;
      6. the fire extinguishing agent contains a percentage of AFFF;
      7. The propellant is either CO2 or nitrogen.

4. The aerosol fire extinguisher with trigger sprayer as recited in claim 1 wherein the propellant is a non-flammable gas such as CO2, air, nitrogen or 134a.

5. The aerosol fire extinguisher with trigger sprayer as recited in claim 1 wherein the fire extinguishing agent is AFFF or a mixture of AFFF with it being the majority percentage.

6. The aerosol fire extinguisher with trigger sprayer as recited in claim 1 wherein the trigger sprayer is made of plastic or metal.

7. The aerosol fire extinguisher with trigger sprayer as recited in claim 1 where in the aerosol can is cylindrical and made of metal or plastic.

8. The aerosol fire extinguisher with trigger sprayer recited in claim 1 wherein the trigger moves up and down and moves the nozzle which then pivots causing the actuator stem to release pressure causing the fire extinguishing agent to Flow up into the direction chamber and out the nozzle.

9. The aerosol fire extinguisher with trigger sprayer recited in claim 1 wherein there is a mounting cup on an aerosol can.

10. The aerosol fire extinguisher with trigger sprayer recited in claim 1 wherein the trigger sprayer unit fits onto a mounting cup on an aerosol can.

11. The invention recited in claim 1 wherein there is an actuator stem.

12. The aerosol fire extinguisher with trigger sprayer recited in claim 1 wherein there is a dip tube.

13. The aerosol fire extinguisher with trigger sprayer recited in claim 1 wherein the nozzle is made of plastic or metal.

14. The aerosol fire extinguisher with trigger sprayer recited in claim 1 wherein there is a tab on top trigger that stops the trigger from being depressed when intact but when removed allows the trigger to be depressed causing the fire extinguishing agent to be dispensed.

15. The aerosol fire extinguisher with trigger sprayer as recited in claim 2 wherein the tab has breakaway hinges and can be snapped off.

16. The aerosol fire extinguisher with trigger sprayer as recited in claim 2 wherein the trigger sprayer unit contains a direction chamber for the fire extinguishing agent to flow through to go out the nozzle.

17. The aerosol fire extinguisher with trigger sprayer as recited in claim 2 wherein the tab can be removed from the trigger assembly that when removed allows the trigger to be depressed and the fire extinguishing agent to flow out the nozzle.

18. The aerosol fire extinguisher with trigger sprayer as recited in claim 2 wherein the tab when not removed locks the aerosol fire extinguisher and prevents it from easily be dispensed for storage.

19. The aerosol fire extinguisher with trigger sprayer as recited in claim 3 wherein the trigger can be depressed by the index finger.

* * * * *